United States Patent [19]

Bar-Nefy et al.

[11] Patent Number: 4,491,053

[45] Date of Patent: Jan. 1, 1985

[54] MINE FIELD CLEARING APPARATUS MOUNTABLE ON A VEHICLE

[75] Inventors: Simcha Bar-Nefy, Omer; Michael Tiomkin, Beersheva, both of Israel

[73] Assignee: Israel Aircraft Industries, Ltd., Lod, Israel

[21] Appl. No.: 383,213

[22] Filed: May 28, 1982

[30] Foreign Application Priority Data

Oct. 9, 1981 [IL] Israel ..... 64023

[51] Int. Cl.[3] ..... F41H 11/12

[52] U.S. Cl. ..... 89/1.13; 171/141; 89/36 H; 37/2 R; 172/828; 172/466

[58] Field of Search ..... 37/2 R, 274, 275; 172/777, 766, 828, 829, 815, 816; 89/1 M, 36 H, 367; 171/1, 23, 44, 46, 47, 50, 81, 139, 141, 142; 414/680

[56] References Cited

U.S. PATENT DOCUMENTS

| | | | |
|---|---|---|---|
| 1,423,887 | 7/1922 | Stewart | 414/443 X |
| 2,322,115 | 6/1943 | Cox | 172/766 X |
| 2,388,015 | 10/1945 | Shoemaker | 414/443 |
| 2,425,357 | 8/1947 | Walker | 89/1 M |
| 2,460,322 | 2/1949 | Walker | 89/1 M |
| 2,486,372 | 10/1949 | Rockwell | 172/777 |
| 2,489,349 | 11/1949 | White | 89/1 M |
| 3,238,647 | 3/1966 | Hall | 172/816 |
| 3,771,413 | 11/1973 | Sieg | 89/1 M |

FOREIGN PATENT DOCUMENTS 914285 6/1946 France .

OTHER PUBLICATIONS

Janes, Combat Support Equipment 1st Ed. 1978–1979, Ed. C. F. Foss Macdonald & Jane's Pubs. Ltd. London 1978 p. 178.

Minenraum–Anbaugerat KMT–5 Soidat und Technik 4/1976, pp. 176–178.

*Primary Examiner*—Richard J. Johnson

*Attorney, Agent, or Firm*—Cushman, Darby & Cushman

[57] ABSTRACT

Apparatus for clearing mines comprising a frame mountable onto a vehicle for selectable positioning in a raised or lowered orientation, plow apparatus for raising and shunting aside mines mounted onto the frame and apparatus for automatically raising the plow from its lowered orientation to its raised orientation in response to backwards motion of the vehicle and including mounting apparatus rotatably mounted onto the vehicle, spring supporting apparatus mounted onto the mounting apparatus and attached to the plow apparatus; and tooth apparatus fixed onto the mounting apparatus and arranged for selectable engagement with a vehicle tread, the spring supporting apparatus being operative when the plow is in its lowered orientation to urge the tooth apparatus into driven engagement with the vehicle tread whereby during backwards movement of the vehicle the mounting apparatus rotates in a first direction, thereby extending the length of the spring supporting apparatus, and increasing the spring force thereof until a spring force is reached at a first position of the mounting apparatus sufficient to raise the plow of its raised orientation. Continued rotation of the mounting apparatus raises the plow until it engages a retaining hook, and is held stationary.

9 Claims, 8 Drawing Figures

MINE FIELD CLEARING APPARATUS MOUNTABLE ON A VEHICLE

FIELD OF THE INVENTION

The present invention relates to apparatus for clearing mines, and more particularly to mine clearing apparatus mountable on an armoured vehicle such as a tank.

BACKGROUND OF THE INVENTION

It is known in tank warfare to employ mine clearing apparatus mounted on a vehicle for clearing a path through a mine-field. Conventional mine clearing apparatus which is mounted on armoured vehicles is relatively cumbersome and often interferes with the fighting ability of the vehicle. This is due to a number of disadvantages. Firstly, once it is desired to pass through a mine field, lowering the mine clearing apparatus into ground engaging position requires a manual operation from outside the tank. Raising of the mine clearing apparatus out of ground engaging position is sometimes done manually and sometimes done by means of a hydraulic or electrical lifter. The hydraulic or electric lifter is extremely susceptible to failure and may be disabled even by small-weapons fire. In such a case, the vehicle may be totally disabled in its mobility. Another difficulty with conventional mine clearing apparatus is that in its raised position, it interferes with the field of vision of the driver of the vehicle and may also interfere with the positioning of the cannon of an armoured vehicle such as a tank.

There is described and claimed in co-pending patent application Ser. No. 383,214 filed May 28, 1982 apparatus for clearing mines which overcomes the difficulties and disadvantages described hereinabove and comprises a frame mountable onto a vehicle for selectable positioning in a raised or lowered orientation, apparatus for raising and shunting aside mines mounted onto the frame; and apparatus for selectably retaining the frame in a raised orientation and comprising control apparatus operable from inside the vehicle for releasing the frame from the raised orientation and allowing it to assume the lowered orientation.

SUMMARY OF THE INVENTION

The present invention seeks to provide an improved version of the mine clearing apparatus described in aforesaid patent application Ser. No. 383,214 filed May 28, 1982, particularly in respect to the apparatus for raising the frame.

There is thus provided in accordance with an embodiment of the present invention apparatus for clearing mines comprising a frame mountable onto a vehicle for selectable positioning in a raised or lowered orientation, plow apparatus for raising and shunting aside mines mounted onto the frame and apparatus for automatically raising the plow from its lowered orientation to its raised orientation in response to backwards motion of the vehicle and including mounting apparatus rotatably mounted onto the vehicle, spring supporting apparatus mounted onto the mounting apparatus and attached to the plow apparatus; and tooth apparatus fixed onto the mounting apparatus and arranged for selectable engagement with a vehicle tread, the spring supporting apparatus being operative when the plow is in its lowered orientation to urge the tooth apparatus into driven engagement with the vehicle tread whereby during backwards movement of the vehicle the mounting apparatus rotates in a first direction, thereby extending the length of the spring supporting apparatus, and increasing the spring force thereof until a spring force is reached at a first position of the mounting apparatus sufficient to raise the plow to its raised orientation. Continued rotation of the mounting apparatus raises the plow until it engages a retaining hook, and is held stationary. Continued backwards movement of the vehicle treads causes the mounting apparatus to continue to rotate in the first direction increasing the length and spring force of the spring support until it passes a second position defining a first dead point at which the longitudinal axis of the spring supporting apparatus intersects the axis of rotation of the mounting apparatus. After it passes the second position the mounting apparatus reaches a third position at which the teeth are disengaged from the treads for free forward movement driven by the spring force of the spring supporting apparatus. The mounting apparatus then rotates under the force of the spring supporting apparatus to a fourth position at which the teeth are totally disengaged from the treads, and the spring supporting apparatus is at a minimum length and spring force.

Further in accordance with an embodiment of the invention, the spring supporting apparatus comprises first and second springs having different spring constants arranged in a series arrangement.

Additionally in accordance with an embodiment of the present invention, at least one of the springs comprises a disk or belleville spring.

Further in accordance with an embodiment of the present invention, the tooth apparatus comprises two teeth, one of which engages the vehicle treads when the frame is in the lowered orientation upon the onset of backwards motion and the other of which becomes disengaged from the vehicle treads upon traversal of the third position, in order to permit spring driven rotation of mounting apparatus.

BRIEF DESCRIPTION OF THE DRAWINGS

The present invention will be more fully understood and appreciated from the following detailed description taken in conjunction with the drawings in which.

DETAILED DESCRIPTION OF THE INVENTION

Figure 1:
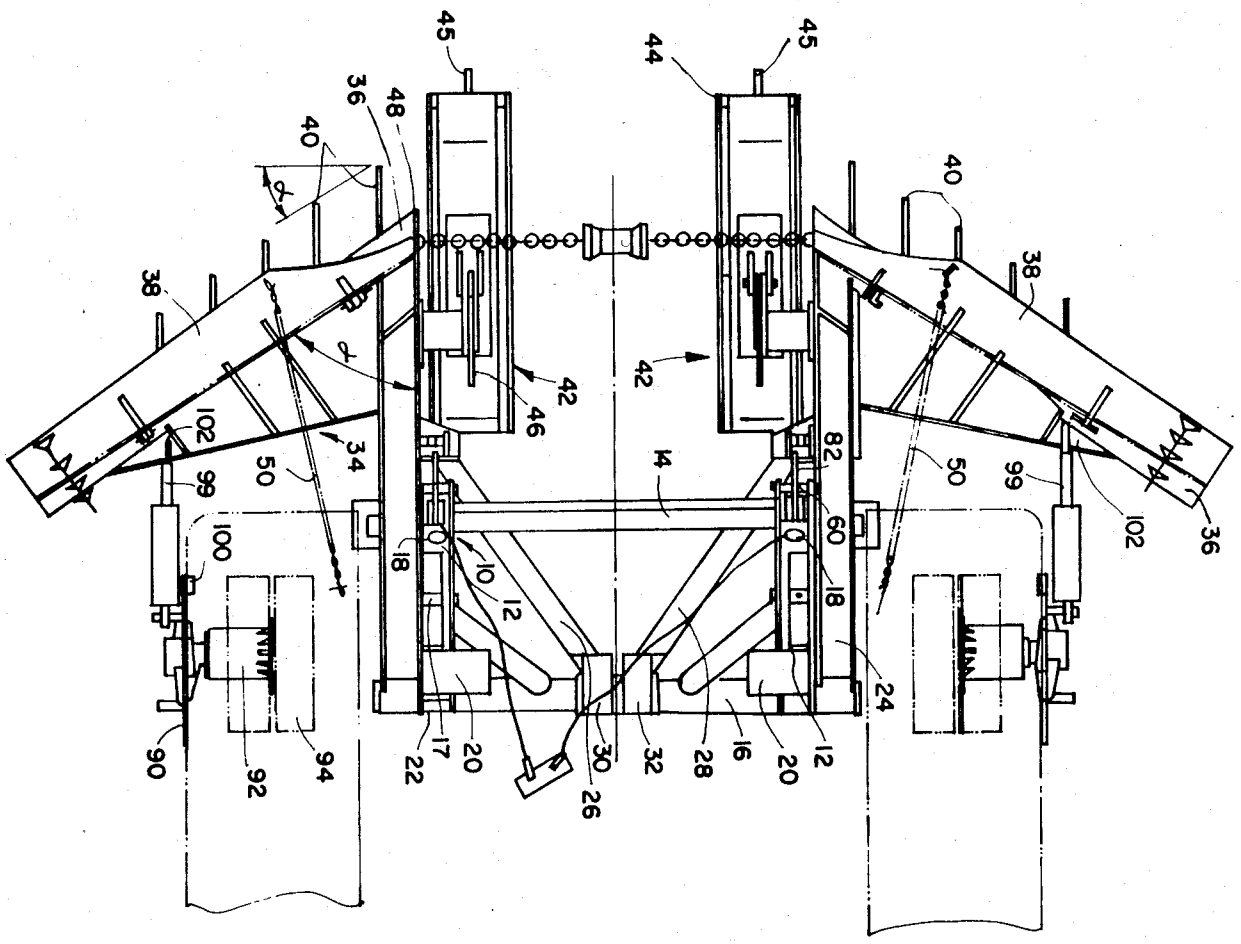
FIG. 1 is a top view illustration of mine clearing apparatus constructed and operative in accordance with an embodiment of the present invention.

Reference is now made to FIGS. 1–5 which illustrate mine clearing apparatus constructed and operative in accordance with an embodiment of the present invention. The present description is presented with particular reference to mine clearing apparatus which is mountable onto a particular type of tank, the M-60 Patton. It is appreciated that this is entirely for the purpose of illustration and that the invention is applicable to other types of tanks and possibly other vehicles as well.

As seen in the illustrations, the mine clearing apparatus comprises a frame 10 including a pair of identical side portions 12 which are joined at their front end by a cross bar 14 and at their rear end support an axle 16. Frame 10 is rigidly mounted onto an armoured vehicle such as a M-60 tank in the illustrated embodiment by engagement of pins 17 located at side portions 12 with towline lugs fixed onto the tank. Rigidity of mounting is provided by bolts 18 which engage the underside of the tank and force mounting plates 20, fixedly mounted onto side portions 12 on the opposite side of pins 17, into tight engagement with the underside hull of the tank.

First and second arms 22 and 24 are independently rotatably mounted onto axle 16 and extend forwardly thereof in generally parallel planes. Arms 22 and 24 are strengthened by reinforcing elements 26 and 28 respectively which are fixed at one end thereof to the respective arms and are rotatably mounted by means of clamps 30 and 32 onto axle 16.

Rigidly mounted onto each of arms 22 and 24 is a mine plowing assembly 34. Mine plowing assembly 34 comprises main plow portion 36, of generally elongate configuration and concave cross section.

The general configuration of main plow portion 36 may be similar to that of an ordinary vehicle powered snow plow. Disposed above main plow portion 36 and hinged thereonto is an auxiliary plow portion 38. Auxiliary plow portion 38 has two positions, a lowered position in which it extends forwardly of the surface of main plow portion 36 and a raised position in which it defines an upper continuation of the surface of the main plow portion 36. This hinged construction is to obviate the problem of interference with a drivers field of vision or with the range of operation of the armament on a tank. Towards this end, the hinged auxiliary plow portion 38 may be lowered when the plowing assembly 34 is in its raised orientation.

Disposed below main plow portion 36 there are provided a plurality of vertically disposed planar blades 40, which during operation are disposed below the ground surface. The horizontal spacing between adjacent vertical blades is selected to be such that anti-vehicle mines will of necessity be engaged thereby. The blades are provided with an inclined forward surface, so as to raise mines located under the ground surface into engagement with main plow portion 36, so that they may be plowed aside.

A desired depth of operation for blades 40 is determined by means of a gliding surface assembly 42 which is articulatedly mounted onto each of arms 22 and 24. The gliding surface assembly 42 comprises a sled 44 which is arranged to slide on the ground surface and is formed at its front with a vertical blade 45 for deflecting mines to the side thereof. Sled 44 is rotatably mounted onto a cam slot of a mounting plate 46. Mounting plate 46 is mounted in turn onto a mounting element 48. It is appreciated that sled 44 is permitted to undergo a somewhat complex articulated motion in a single plane within limits defined by the respective cam paths. This mounting arrangement permits selectable adjustment of the penetration depth of the plowing assembly 34 and also permits the sled 44 to be folded when the plowing assembly is in its raised orientation to eliminate interference with operation of the tank.

A chain 50 extends from each auxiliary plow portion 38 to a location on the tank hull or onto frame 10. The length of the chain 50 is selected such that it is slack when the plowing assembly is in its raised orientation but becomes tight when the plowing assembly is lowered, thus pulling on auxiliary plow portion 38 and orienting it towards a generally vertical orientation. The full raised orientation of the auxiliary plow portion 38 is reached only when soil being plowed is forced thereagainst.

Figure 7A:
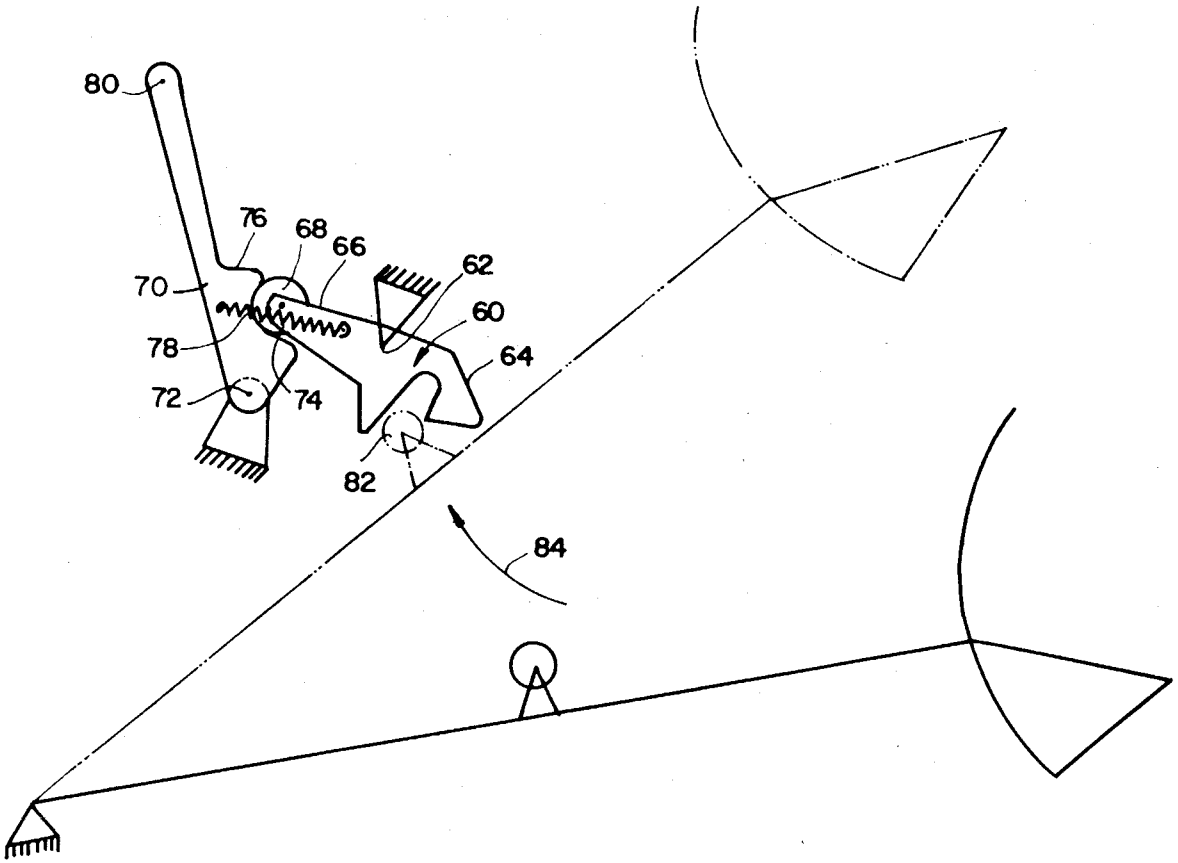
FIGS. 7A and 7B are respective views of a locking mechanism forming part of the apparatus of FIGS. 1, 2 and 3 in respective unlocked and locked orientation.
Figure 7B:
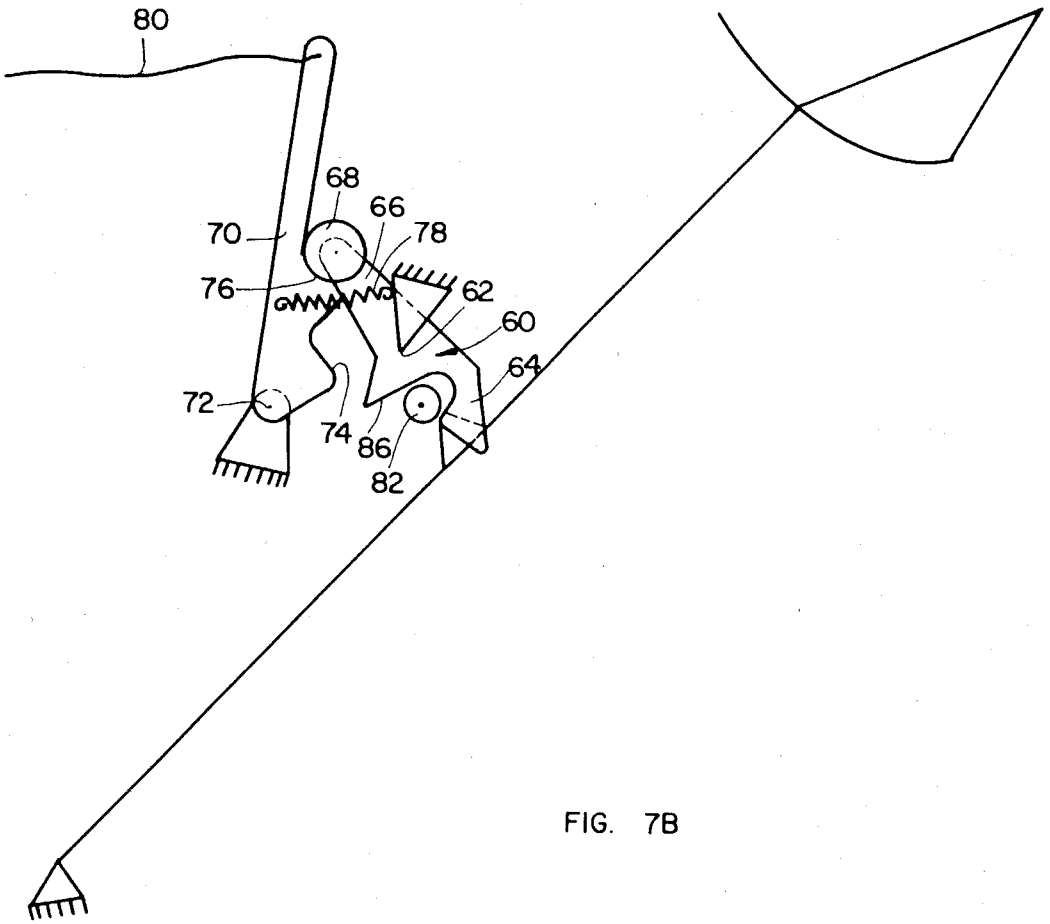

Reference is now made additionally to FIGS. 7A and 7B, which together with FIGS. 1–6 illustrate apparatus for retaining the arms in their raised orientation and for selectable release thereof. A hook member 60, is pivotably mounted about an axis 62 onto each side portion 12 and comprises a socket portion 64 located at one end thereof and a roller portion 66 at another end thereof and having mounted thereon a roller 68. A selectable release lever 70 is pivotably mounted onto each side portion 12 about an axis 72 and defines first and second roller support shoulders 74 and 76. A spring 78 joins hook member 60 and release lever 70, urging lever 70 into seating engagement with roller 68 at one of shoulders 74 and 76. A cable connection 80 is provided to the interior of the vehicle, such that pulling on the cable is operative to provide counter-clockwise movement of lever 70 about its pivot axis 72 (as seen in FIGS. 7A and 7B).

The operation of the apparatus described hereinabove will be understood from a consideration of FIGS. 7A and 7B. FIG. 7A shows a retainer roller 82 which is fixedly mounted onto each of arms 22 and 24 about to engage socket portion 64 and moving in an arc illustrated by an arrow 84. Engagement of roller 82 with a surface 86 of the socket portion forces the hook member to pivot in a clockwise direction about its pivot axis 62 (in the sense of FIGS. 7A and 7B). Due to the action of roller 68 against hook member 60, and the subsequent tendency of hook member 60 to rotate in a counterclockwise direction in response to the effect of gravity on roller 82 and the massive plowing assembly attached thereto, roller 68 seats on shoulder 76 and is then prevented from further counterclockwise rotation into an open orientation. Roller 82 is thus securely engaged by hook member 60 and arms 22 and 24 are maintained in their respective raised orientation, provided that lever 70 remains in the seated position. (FIG. 7B)

When it is desired to lower arms 22 and 24 to their respective lowered, ground engaging orientations, it is sufficient to pull on respective cables 80 from the safety of the driver's compartment. Pulling of cables 80 causes the lever 70 to pivot in a counterclockwise direction and out of supporting engagement with roller 68. Hook member 60 is then free to rotate in a counterclockwise direction about its pivot such that pin 82 is released, thus allowing arm 22 or 24 as the case may be and the associated mine plowing assembly 34 to fall by gravity into their respective lowered orientations in engagement with the ground. Meanwhile, under the influence of spring 78, roller 68 seats on support shoulder 74. It is appreciated that the particular construction of the hook member 60 and the lever 70 enable the release of the mine plowing assembly to be achieved with relatively little pull force on cable connection 80.

Reference is now made once again to FIGS. 1–5 which also illustrate apparatus for automatically lifting the mine plowing assembly. There are provided two installations of such apparatus, corresponding to the two mine plowing assemblies. The apparatus for automatically lifting the mine plowing assembly comprises a freely rotatable disk segment 90 which is bearing mounted onto a mounting member 92 which is bolted onto a tension wheel 94 of a tank. Tension wheel 94 engages the tread of the tank and maintains it at a desired tension. Mounted on an outer facing surface of disk segment 90 at a first radius from the pivot location 93 about which the disk segment rotates, is a mounting pin 95. Mounted on an edge surface of disk segment 90 are first and second spaced teeth 96 and 98 which selectably engage the interstices defined between plates of the tank tread in accordance with an embodiment of the invention.

Spring supporting apparatus 99 comprises a spring housing 100 which is rotatably mounted at a first end thereof onto mounting pin 95 and a spring compressing rod 105 which is connected at an exterior end thereof to a location 102 fixed onto the main plow portion 36. Spring supporting apparatus 99 may be generally described as comprising a spring loaded extensible support member formed of elements 100 and 105 and comprising first and second springs 101 and 103 arranged in a series arrangement. Springs 101 and 103 preferably have greatly different spring forces. Typically, spring 101 is an ordinary heavy duty coil spring while spring 103 comprises a series of independent disk or belleville springs which are characterized in that they undergo complete compression at a compressive force of about 7 ton. It is appreciated that any other suitable spring arrangement may be employed alternatively and that the arrangement of apparatus 99 is such that extension of apparatus 99 produces compression of springs 101 and 103.

The operation of spring supporting apparatus 99 and of the entire apparatus for automatically lifting the mine plowing assembly will now be described with reference to FIGS. 2–5.

In order to understand the operation of the automatic lifting apparatus, it is necessary to appreciate the details of construction of disk segment 90 and the relative positions of teeth 96 and 98 and pin 95 thereon. As seen in the drawings, the direction of motion of the tank treads during reverse motion of the tank is indicated by an arrow 104. Upon engagement of at least one of teeth 96 and 98 with the tank treads, the disk segment 90 is caused to rotate in a clockwise direction, indicated by an arrow 106 about pivot location 93. With respect to this direction of rotation, indicated by an arrow 107, pin 95 leads tooth 96 by about 20° and tooth 96 leads tooth 98 by about 90°.

Figure 2:
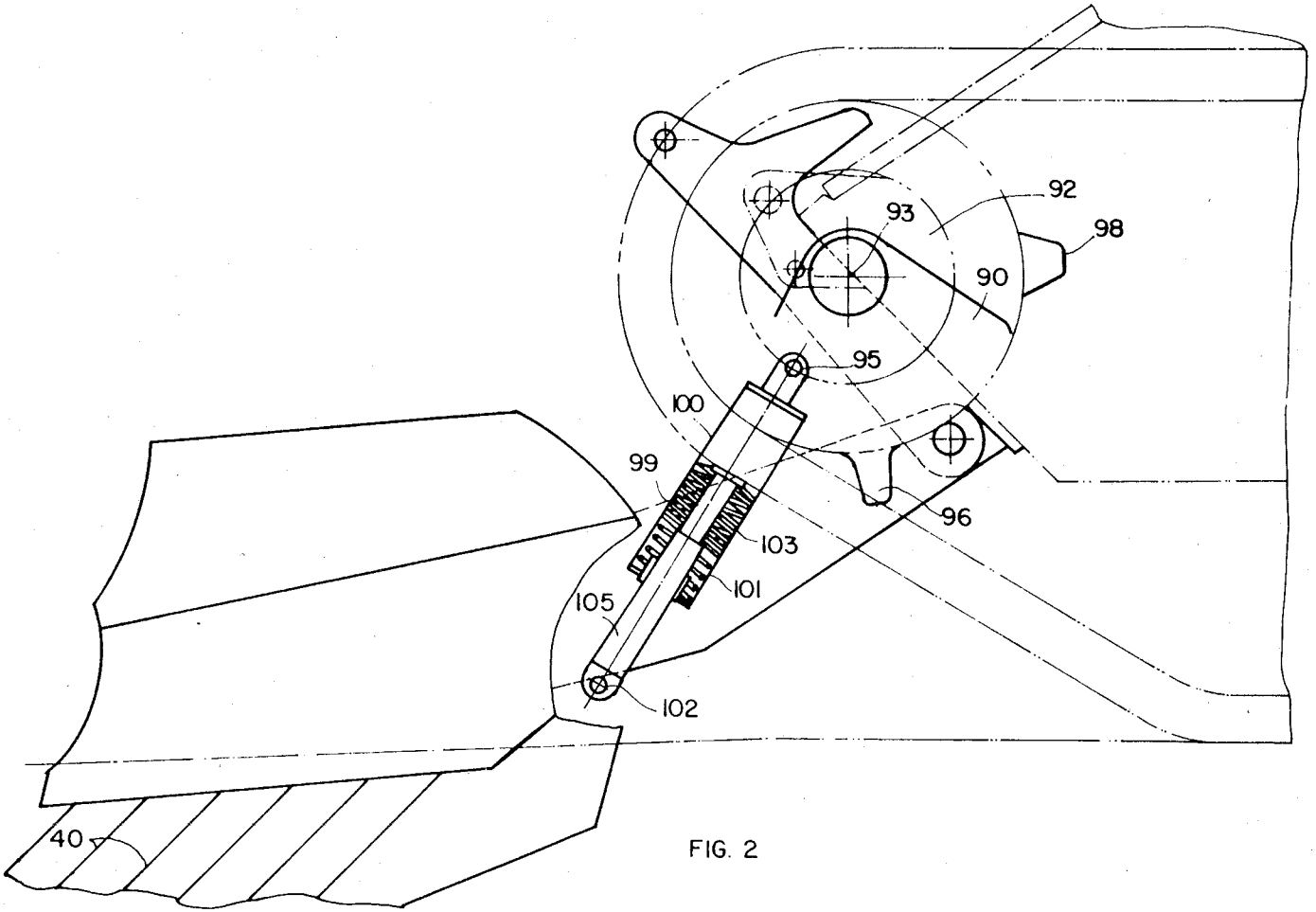
FIG. 2 is a side view illustration of the apparatus of FIG. 1 in a lowered orientation.

FIG. 2 shows the plowing assembly in a fully lowered plowing orientation prior to engagement of tooth 96 with the tank treads. In this orientation, spring 101 is compressed to about one-half of its maximum length. This is the orientation during forward mine clearing operation of the tank.

When it is desired to raise the mine clearing apparatus to a raised orientation, the tank simply shifts to reverse motion. Due to the position of tooth 96 which is pressed against the tank tread during motion in a forward direction as illustrated in FIG. 2, reverse motion of the tank tread in a direction indicated by arrow 104, tends to draw tooth 96 into driven engagement therewith, causing clockwise rotation of disk segment 90 in a direction indicated by arrow 107. An initial backwards movement of the tank causes the blades 40 to lie on the ground surface instead of being buried partially therebelow.

Figure 3:
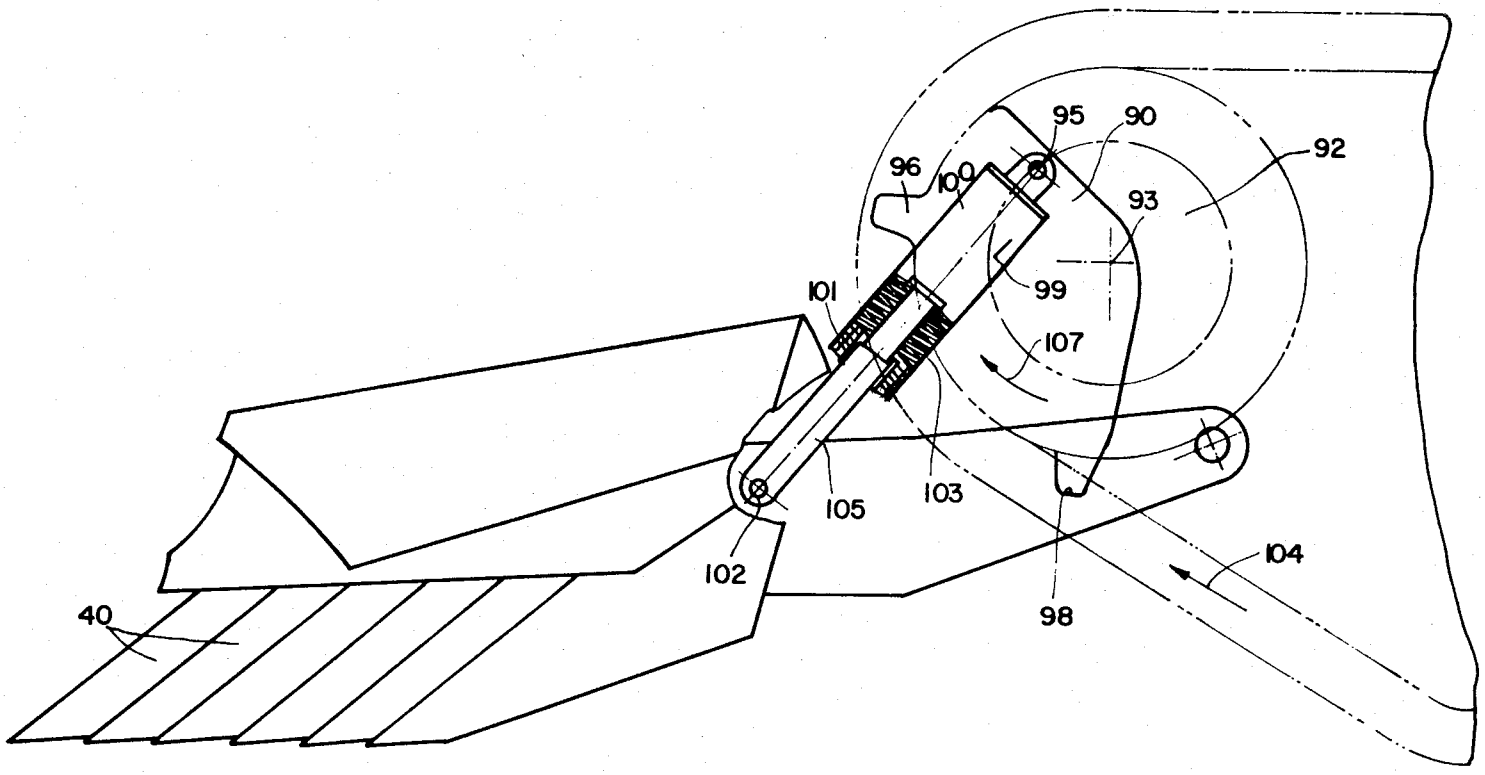
FIG. 3 is a side view illustration of the apparatus of FIGS. 1 and 2 in a partially raised orientation.

Continued backward motion of the tank and consequent clockwise rotation of disk segment 90 causes the length of supporting apparatus 99 to increase until spring 101 is fully compressed, as seen in FIG. 3. It is a particular feature of the invention that the force required to fully compress spring 103 is greater than the force required to lift the plowing apparatus. Consequently, further backwards motion of the tank and clockwise rotation of disk segment 90 causes lifting of the plowing apparatus to a fully raised orientation. At the fully raised orientation roller 82 engages hook member 80 in locked engagement for retaining the arm and associated plowing assembly in the raised orientation and preventing further upward movement thereof.

It may be appreciated that a series combination of a relatively weak spring 101 and a relatively strong spring 103 are employed in spring support apparatus 99 for a number of reasons. One reason is to present a relatively weak spring force during plowing operation so as not to force tooth 96 against the tank tread with excessive force during plowing operations which could cause excessive wear of tooth 96. A second reason is not to cause inadvertent disengagement of the plowing apparatus from the soil due to the force of spring support apparatus 99. The strong spring 103 is, however, predominant during the lifting operation. As seen in FIG. 3, the weak spring 101 is quickly fully compressed at the beginning of the lifting operation and thus is neutralized, allowing the spring force of the strong spring 103 to predominate.

It is also appreciated that the provision of a spring element such as spring 103 is very desirable in the apparatus since it provides the needed flexibility in the coupling apparatus to enable locking of the plowing apparatus in its raised position under different conditions, such as different positions of the tank tension wheel and thus of pivot location 93 during operation.

Figure 4:
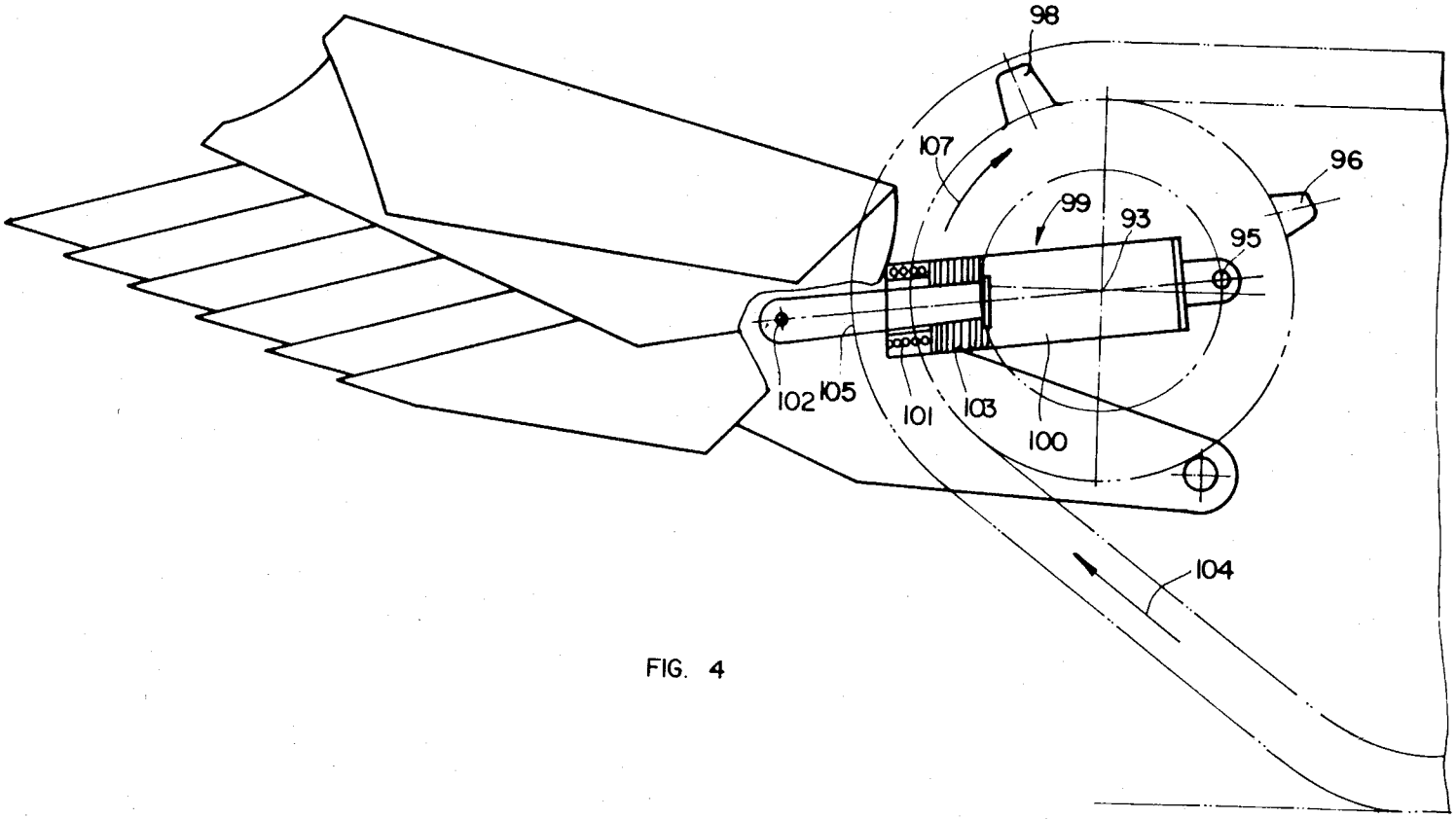
FIG. 4 is a side view illustration of the apparatus of FIGS. 1–3 in a raised orientation with the spring support apparatus at a first dead point orientation.
Figure 5:
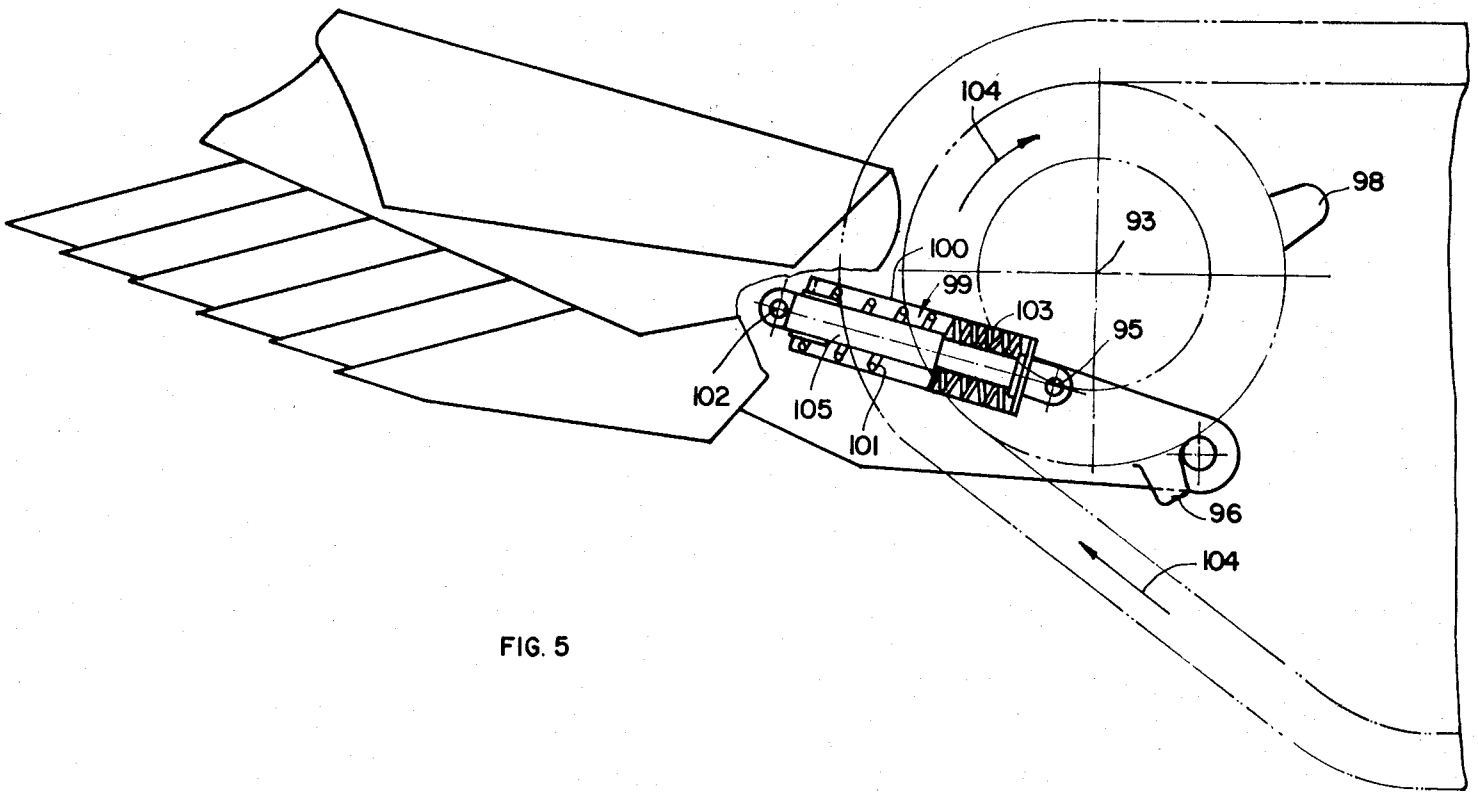
FIG. 5 is a side view illustration of the apparatus of FIGS. 1–4 in a raised orientation.
Figure 6:
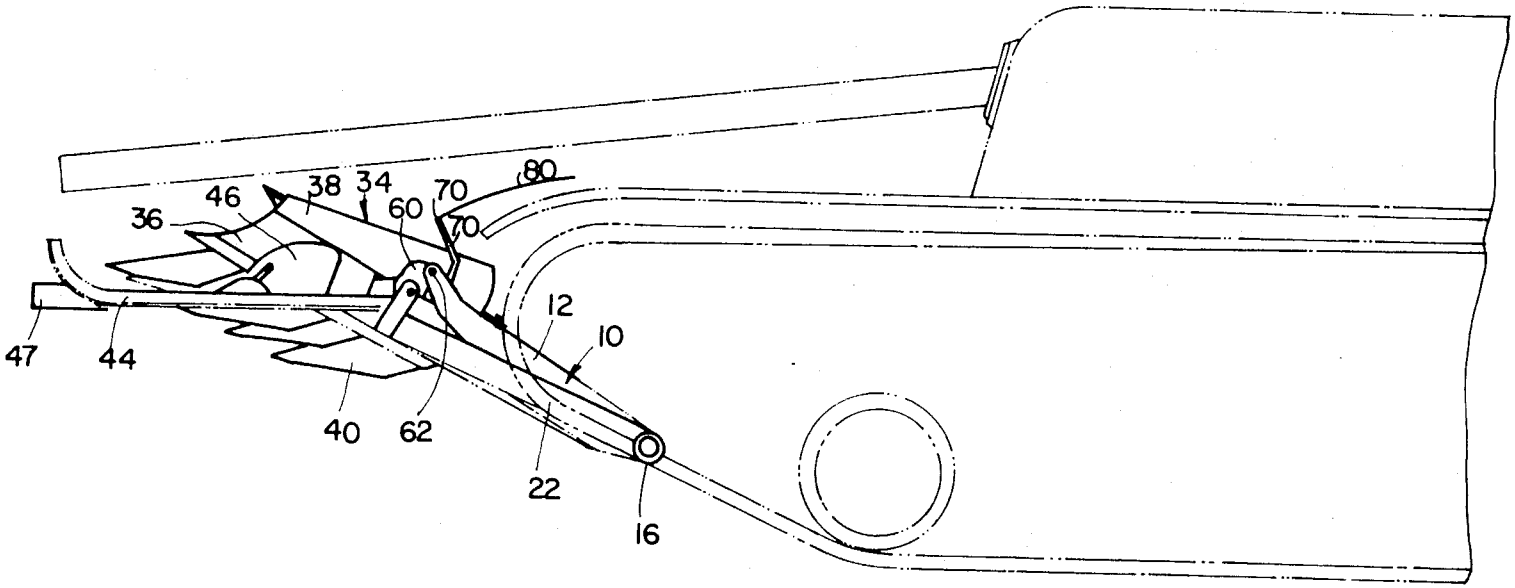
FIG. 6 is a side view illustration of the apparatus of FIGS. 1–5 in a raised orientation.

With continued backwards movement of the tank treads, the disk segment 90 continues to rotate due to the engagement of tooth 98 with the treads, even after tooth 96 becomes disengaged therefrom. This continued rotation combined with the immobility of the plowing assembly due to its raised locked orientation causes spring 103 to become compressed. Maximum compression occurs at an orientation illustrated in FIG. 4, wherein the longitudinal axis of spring supporting apparatus 99 intersects the axis of rotation of disk segment 90 at pivot location 93. The orientation illustrated in FIG. 4 represents a dead point at which the spring supporting apparatus does not urge rotation of the disk segment 90 in either direction. Once disk segment 90 moves even slightly over the dead point orientation of FIG. 4, the spring force of the spring supporting apparatus 99 urges clockwise rotation of the disk segment 90. Further rotation of the disk segment 90 in response to further movement of the tank tread in a backwards direction is operative to permit disengagement of tooth 98 for the tread. The spring force of springs 101 and 103 is then operative to snap the disk segment 90 in further clockwise motion to a final orientation, illustrated in FIG. 5, wherein the spring force of the spring supporting apparatus 99 is at a minimum and the teeth 96 and 98 are fully disengaged from the tank tread. Rod 105 defines the minimum length of apparatus 99.

The click of the decompression of the springs 101 and 103 provides a noise sensible to the driver of the tank, indicating to him that he can commence forward motion of the tank with the plowing assembly in a raised orientation.

A limit chain is provided for attachment between frame 10 and each of arms 22 and 24 to prevent arms 22 and 24 from falling beyond a certain limit in the event that a sudden drop in the ground level is encountered, as such a drop could otherwise bring the plowing assembly into engagement with the tank treads.

It is noted that the plowing assembly engages the ground surface in the vicinity of the treads and outwardly thereof. In order to protect the intermediate portion of the tank from mine damage, a weighted chain 120 is mounted between the two plowing assemblies to engage and detonate any mines that are encountered at a safe distance from the tank.

It will be appreciated by persons skilled in the art that the invention is not limited to what has been particularly shown and described hereinabove. Rather, the scope of the invention is defined only by the claims which follow:

We claim:

1. Apparatus for clearing mines for attachment to a vehicle including a vehicle tread and comprising:

an arm mountable onto a vehicle for selectable positioning;

plow means mounted onto said arm for raising and shunting aside mines and being selectably positioned in a lowered or raised orientation;

means for automatically raising said plow means from its lowered orientation to its raised orientation in response to backwards motion of said vehicle and including:

mounting means rotatably mounted onto said vehicle;

spring supporting means adapted for selective increase in length to produce a corresponding increase in spring force of the spring supporting means mounted onto said mounting means and attached to said arm; and tooth means fixed onto said mounting means and arranged for selectable engagement with said vehicle tread;

said spring supporting means being operative when said plow means is in its lowered orientation to urge said tooth means into driven engagement with said vehicle tread whereby, during backwards movement of the vehicle, said vehicle tread causes said mounting means to rotate in a first direction, said spring supporting means being operative to increase its length as said mounting means rotates in said first direction until said mounting means reaches a first position at which the spring force of said spring supporting means is operative to raise said plow means to its raised orientation.

2. Apparatus according to claim 1 and wherein further rotation of said mounting means beyond said first position in said first direction causes said mounting means to reach a second position at which the spring supporting means is oriented such that its longitudinal axis intersects the axis of rotation of said mounting means, which second position defines a dead point at which said spring supporting means does not urge rotation of said mounting means in either direction.

3. Apparatus according to claim 1 and wherein further rotation of said mounting means beyond said second position in said first direction causes disengagement of said tooth means from said vehicle tread and enables further rotation of said mounting means in said first direction driven by said spring supporting means to a final orientation at which said spring supporting means is at its minimum length and said tooth means are totally disengaged from said vehicle tread.

4. Apparatus according to claim 1 and wherein said spring supporting means comprises a series arrangement of first and second springs.

5. Apparatus according to claim 4 and wherein said second spring comprises a plurality of disk springs.

6. Apparatus according to claim 1 and wherein said tooth means comprise first and second teeth.

7. Apparatus according to claim 6 and wherein said first tooth is arranged to initially engage the vehicle tread upon initiation of backwards motion of the tread.

8. Apparatus according to claim 6 and wherein said second tooth is arranged to disengage from the vehicle tread upon rotation of said mounting means under the urging of said spring supporting means.

9. Apparatus according to claim 6 and wherein said spring supporting means is mounted onto said mounting means at a first mounting location and wherein said first mounting location leads said first tooth by approximately 20° and said first tooth leads said second tooth by approximately 90°, leading being defined with respect to the direction of rotation of said mounting means during raising of said plow means.

* * * * *